US006764374B2

(12) United States Patent
Tilbor et al.

(10) Patent No.: US 6,764,374 B2
(45) Date of Patent: Jul. 20, 2004

(54) TOY VEHICLE WITH MULTIPLE GYROSCOPIC ACTION WHEELS

(75) Inventors: Neil Tilbor, New Smyrna Beach, FL (US); Michael G. Hetman, New Smyrna Beach, FL (US)

(73) Assignee: Leynian Ltd. Co., New Smyrna Beach, FL (US)

( * ) Notice: Subject to any disclaimer, the term of this patent is extended or adjusted under 35 U.S.C. 154(b) by 119 days.

(21) Appl. No.: 10/066,468

(22) Filed: Jan. 31, 2002

(65) Prior Publication Data

US 2002/0137428 A1 Sep. 26, 2002

(51) Int. Cl.[7] ..... A63H 1/00; A63H 17/00
(52) U.S. Cl. ..... 446/233; 446/437; 446/465
(58) Field of Search ..... 446/454–457, 446/460, 462, 465, 470, 471, 233, 437

(56) References Cited

U.S. PATENT DOCUMENTS 3,646,706 A * 3/1972 Adickes ..... 446/465
4,197,672 A * 4/1980 Mabuchi et al. ..... 446/456
4,556,396 A * 12/1985 Kennedy et al. ..... 446/23
4,685,894 A * 8/1987 Beny et al. ..... 446/435
4,892,503 A * 1/1990 Kumazawa ..... 446/456
5,429,543 A * 7/1995 Tilbor et al. ..... 446/456
5,919,075 A * 7/1999 George et al. ..... 446/437
6,024,627 A * 2/2000 Tilbor et al. ..... 446/456
6,439,948 B1 * 8/2002 Ostendorff et al. ..... 446/154
6,506,096 B1 * 1/2003 Ishimoto ..... 446/437

* cited by examiner

*Primary Examiner*—Jacob K. Ackun
*Assistant Examiner*—Faye Francis
(74) *Attorney, Agent, or Firm*—Keusey, Tutunjian & Bitetto, P.C.

(57) ABSTRACT

A radio controlled vehicle have greater than two gyroscopic action wheels provides a wider range of stunt options and increased stability during operation. The overall weight of the vehicle with respect to the combined mass and gyroscopic force which the gyroscopic wheels can produce for given rpm speeds is maintained within a predetermined operating range in order to provide the increased stunt maneuverability and stabilization during operation. The torque reaction of opposing gyroscopic wheels or wheel pairs creates a range stunt inducing forces/actions equal to or greater than the gyro effect created by the respective wheels. The combination of the torque reaction and gyro effect broadens the scope of existing stunt capabilities and make possible a completely new range of stunt inducing actions not available in other radio control toys.

13 Claims, 10 Drawing Sheets

TOY VEHICLE WITH MULTIPLE GYROSCOPIC ACTION WHEELS

BACKGROUND OF THE INVENTION

1. Field of the Invention

The present invention relates to toys having gyroscopic wheels, and more particularly to toys having three or more gyroscopic wheels.

2. Description of the Related Art

The concept of gyroscopic wheels and their effect in remote controlled toy applications has been shown in U.S. Pat. No. 6,024,627 to Tilbor et al. The remotely controlled toy vehicle of the '627 patent includes a pair of parallel front wheels, a pair of rear wheels and a pair of remotely controlled reversible electric motors each driving a separate one of the pair of rear wheels independently of the other motor and wheel. This independent control of the rear wheels enables the controller to selectively propel and steer the toy during operation.

The overall design of the toy in conjunction with rear wheel design are significant factors in the dynamic control and operation of the '627 toy. In order to provide the gyroscopic action of the rear drive wheels, a large percentage of the overall weight of the wheel is distributed about the outer circumference of the wheel. This weight re-distribution provides the toy with increased stabilization resulting from the gyroscopic effect created by the high speed revolution of the toy's rear wheels. The increased stabilization enables the toy to perform unique stunts and move faster and a in a significantly more controlled manner. However, this toy is limited in its stunt capability based on the fact that the front wheels are not driven by motors and are therefore passively driven by the rear wheels. Thus, the gyroscopic action is limited to the rear pair of opposing wheels.

SUMMARY OF THE INVENTION

It is an object of the invention to provide a toy vehicle having more than two remotely controlled motor driven gyroscopic action wheels.

This and other objects are achieved in accordance with an embodiment of the present invention in which one or more driven gyroscopic action wheels are added to a two-wheel drive vehicle. The gyroscopic action wheels are independently driven by either independently driving all wheels on each side of the vehicle or independently driving opposing pairs of wheels. According to one embodiment of the invention, the gyroscopic wheels are designed so that the overall weight of the vehicle with respect to the weight of the wheels falls within predetermined design criteria to obtain maximum stability in a dynamically changing stunt environment during operation.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings wherein like reference numerals denote similar elements throughout the views.

DETAILED DESCRIPTION OF PREFERRED EMBODIMENTS

Figure 1:
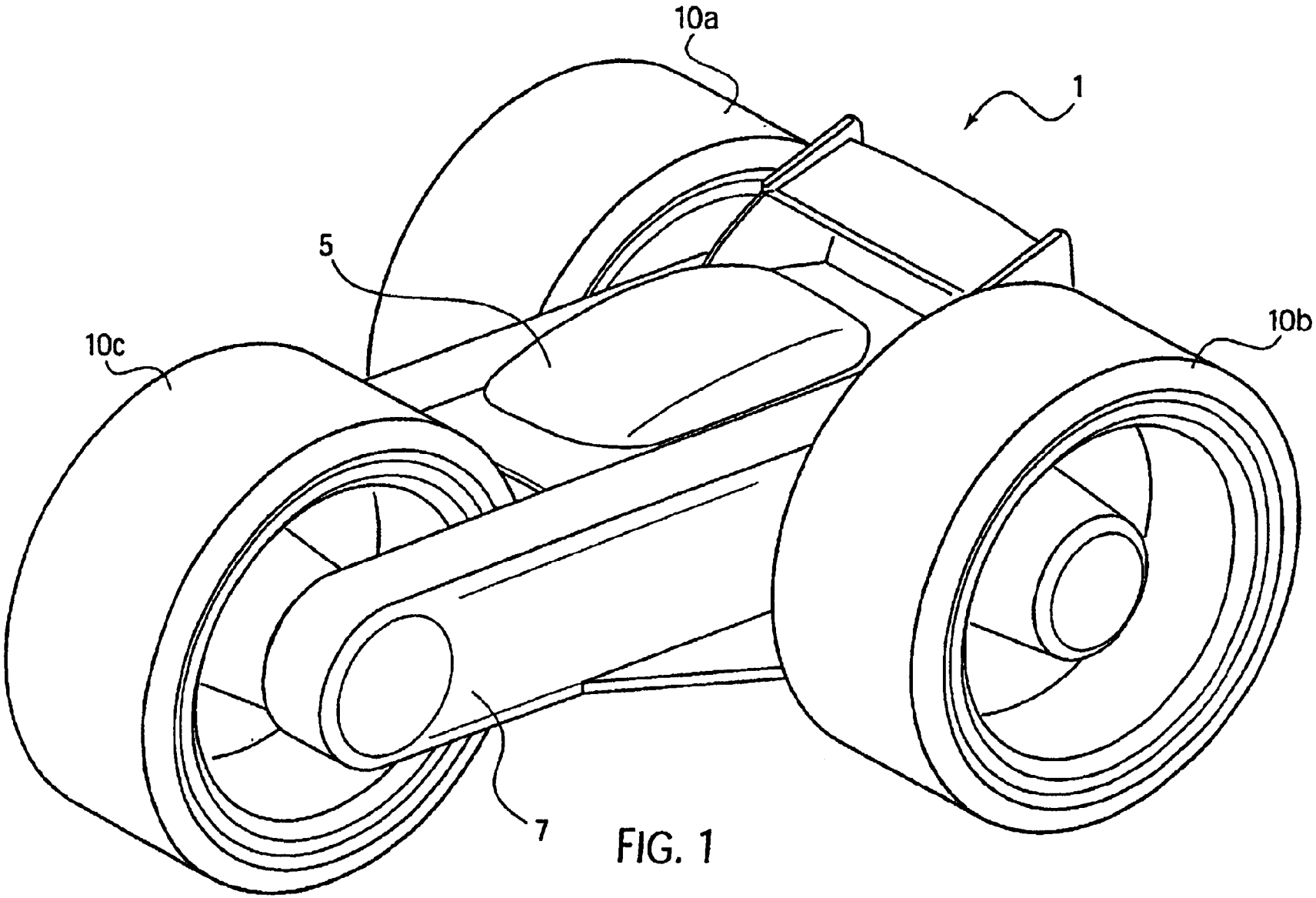
FIG. 1 is a perspective view of a toy having three gyroscopic action wheels according to a first embodiment of the invention.

FIG. 1 shows an embodiment of a three-wheeled toy 1 having a main body 5, two rear wheels 10*a* and 10*b* and a third front wheel 10*c* connected to the main body through a body extension 7. These gyroscopic action wheels will be described later with reference to FIGS. 5 and 6. Body 5 includes all the motors and spur and/or differential gears for driving each of the respective wheels. One of ordinary skill will recognize that body 5 can change in shape and design to accommodate all necessary internal gears and electronics. The gearing and drive mechanisms for front wheel 10*c* are enclosed by body extension 7. In addition, all radio control electronics and batteries are contained within main body 7. Those of ordinary skill understand the implementation of the radio controls and internal motor assemblies of these types of radio controlled vehicles. Example of such implementations can be seen in U.S. Pat. No. 6,024,627, the entire contents of which is incorporated herein by reference.

The toy 1 can include one, two or three separate motors for driving the respective gyroscopic action wheels. In addition, a steering servo can be included to steer front wheel 10*c* in the three wheel configuration. Depending on the motor configuration, the rear wheels 10*a* and 10*b* can be driven independent of each other or together, and the front wheel 10*c* can be selectively driven by the user (i.e., motor driven that can be active or passive-on or off depending on the desire operation of the toy.

By using more than two gyroscopic action wheels in the various embodiments of the present invention, the overall stabilization of the vehicle during operation is increased, and a significantly larger range of stunt actions and dynamic movements are now available for the user. A few examples of these stunts include controlled wheelies, spins in any degree range (0–360), rolling, instantaneous flipping in either direction including barrels rolling, end over end rolls and edge running. The range of stunts and tricks capable of being performed by the toy vehicle of the invention are limited only by the user's ability to control them.

Furthermore, since the gyroscopic action wheels of the present invention are remotely and independently controlled by the user, the type of terrain on which the vehicle is operated is irrelevant as the vehicle can pass through all types of terrain. Provided the main body of the vehicle is sealed accordingly, it is also contemplated that the vehicle of the present invention can traverse through water.

Figure 2:
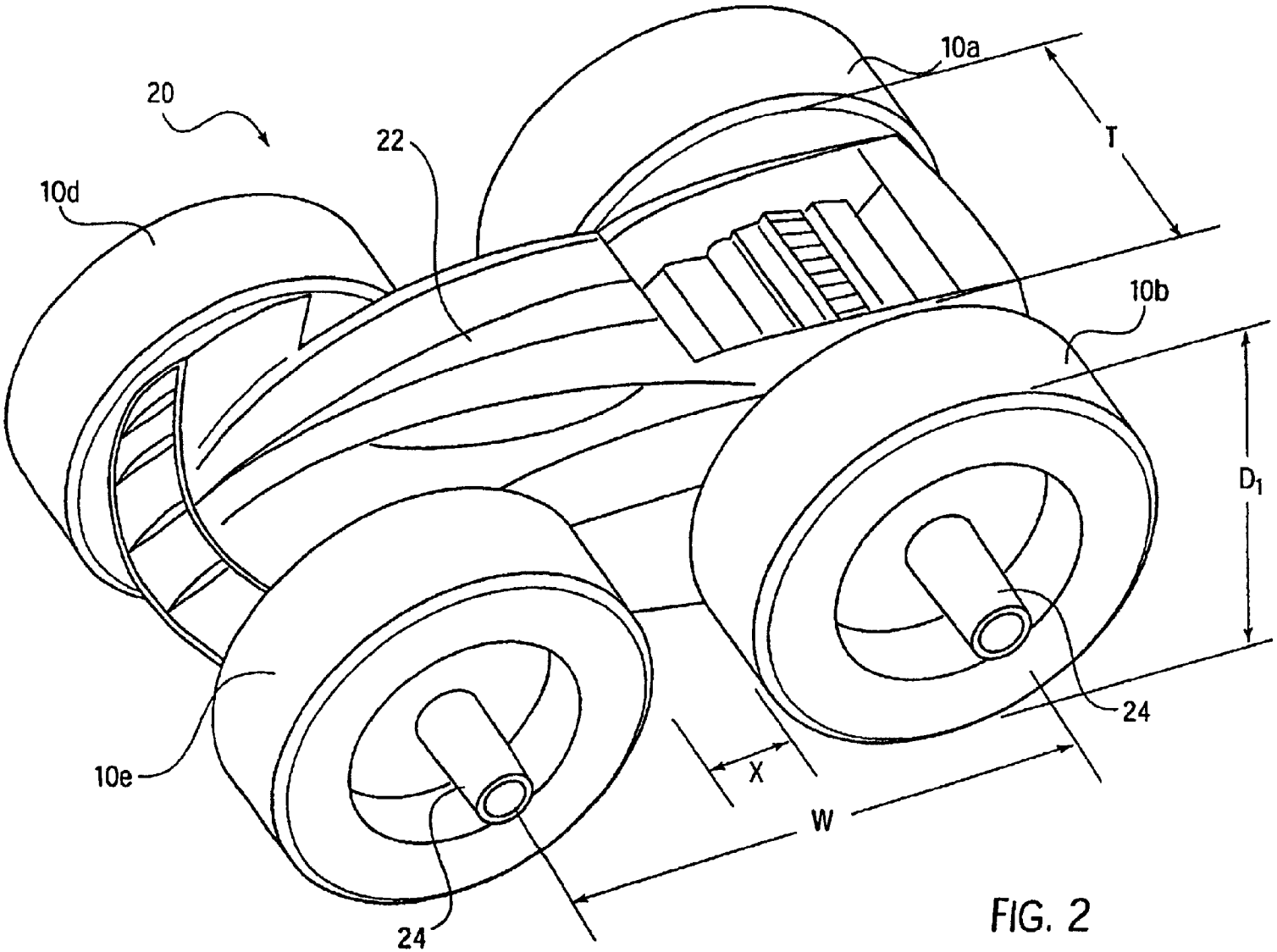
FIG. 2 is a perspective view of a toy having four gyroscopic action wheels according to a second embodiment of the invention.
Figure 7:
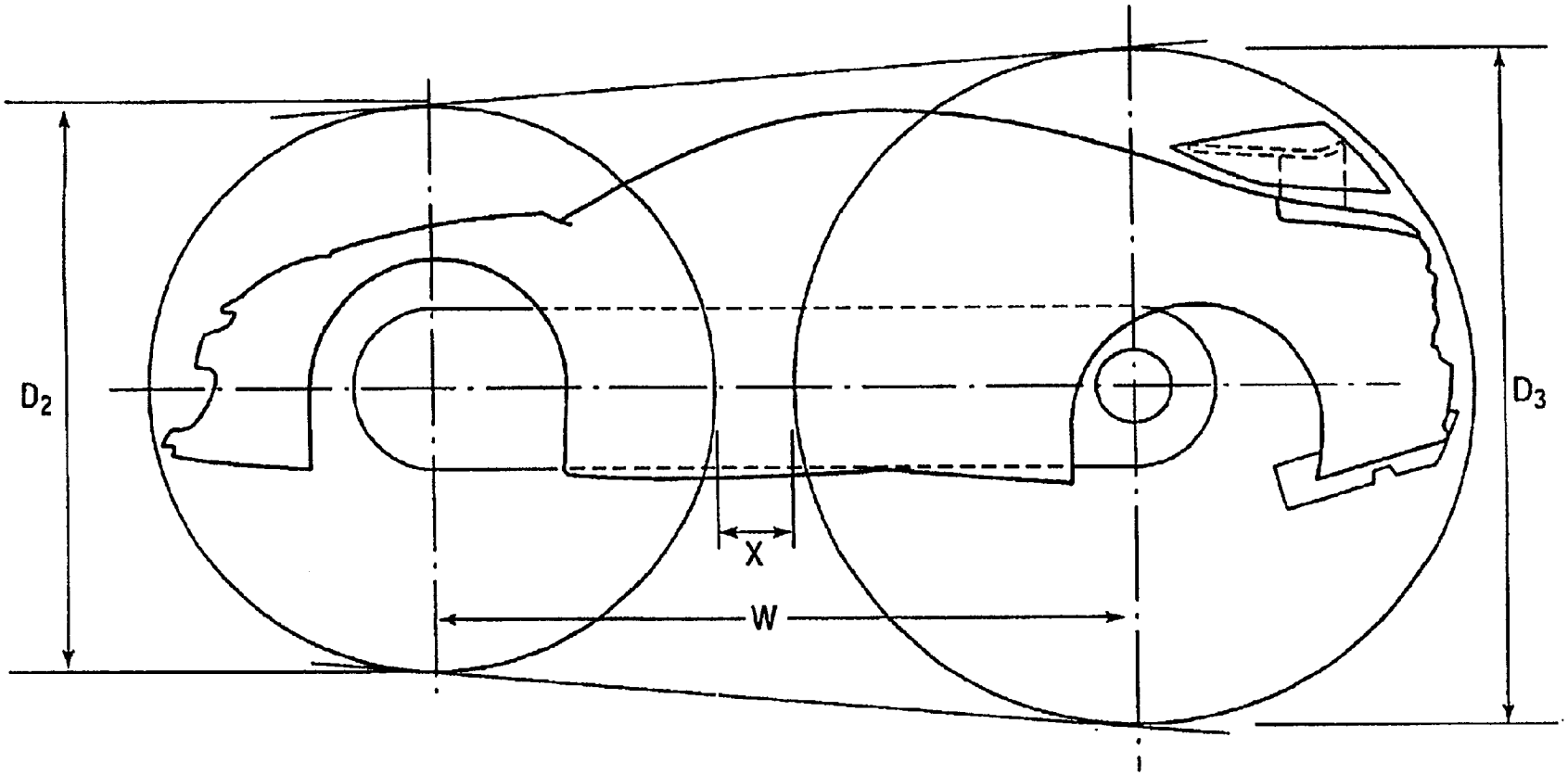
FIG. 7 is a schematic representation of the toy having different diameter front and rear wheels.

FIG. 2 shows a four-wheeled toy 20 having a main body 22 and four gyroscopic action wheels 10*a*, 10*b* and 10*d*, 10*e* arranged in rear and front pairs, respectively. In this embodiment, all wheels 10*a*, 10*b*, 10*d* and 10*e* are driven wheels. In one preferred embodiment, the side pairs of wheels 10*a*, 10*d* and 10*b*, 10*e* are remotely and independently controlled by reversible internal motors connected through any combination of spur and/or differential gears. U.S. Pat. No. 6,024,627 (incorporated herein by reference) shows the use of two independent motors for driving each rear wheel. In accordance with the present invention, additional differential and/or spur gearing enabled the connection of one motor to each side pairs of wheels (FIG. 7). When the side pairs of wheels are arranged as shown in FIG. 2, the distance X between the outermost circumferential surface of each wheel of the respective pair is preferably as close as possible. According to one preferred embodiment, X is no less than ½ inch in order to eliminate the possibility of creating a pinch point between the respective wheels.

In order to assure the most exciting and dynamic operation of this four gyroscopic action wheeled vehicle, it is preferable to maintain the inside track distance T between the rear wheels 10*a* and 10*b* and between front wheels 10*d* and 10*e* within certain operating parameters. One example of such parameter is described for the rear gyroscopic wheels in U.S. Pat. No. 6,024,627. The gyroscopic effect of the wheels is increased when the outside diameters $D_1$ of the wheel increases with respect to the distance T between the inner surface of opposing wheels, i.e., the "inside track" which is the respective distances between wheels 10*a* and 10*b* and 10*d* and 10*e*. In order to assure dynamic stunt action, the wheelbase W (i.e., the distance between front and rear hubs) is critical with respect to the wheel diameters $D_1$. That is, for any given wheelbase, it is desirable to have the outside diameter of the wheels to be as large as possible without intersecting each other. The inside track dimension T and wheelbase W also have a direct effect on each other (i.e., the wheelbase should be as close to the inside track dimension T as possible), combined with the largest diameters $D_1$ possible for best gyro induced stunt action. In one preferred embodiment, the inside track T and wheelbase W are substantially equal.

A relatively shorter wheelbase W or inside track T, or both creates shorter polar moments of inertia (i.e., minimal with respect to the wheelbase and inside track to reduce lateral moment of inertia) which allows the available gyro effect and torque reaction to operate with greater leverage against the vehicle mass. Thus, making more violent and dynamic stunt actions possible.

By placing gyroscopic action wheels on the front and rear of the vehicle, we have effectively placed large flywheels at the wheel positions of the vehicle. The wheels are optimized to be efficient flywheels. The use of flywheels to store energy and stabilize vehicles has been done before. However, the present invention not only utilizes the stabilization effects of the gyroscopic action wheels (i.e., flywheels), but also harnesses the destabilization of such energy, the centrifugal forces created by the respective flywheels, the torque reaction on the vehicle body resulting from the instantaneous variation of the flywheel speed, the direction and angle of contact of the wheels with the running surface, and the number of wheels in contact with the ground at any given time in order to induce and create stunt forces and resulting actions never before available in a radio controlled toy. By way of example, the motor driving a pair of wheels (e.g., opposing wheels or wheels on the same side of the vehicle) can be instantaneously reversed. This instantaneous reversing of a flywheel creates a destabilization effect of the stored energy. By way of example, those of skill in the art will recognize that the maximum torque output of an electric motor is when the motor is stalled from its operating rpm to 0 rpm. Thus, it is clear that the instantaneous stopping and reversing of one of the motors controlling one pair of gyroscopic action wheels will cause the centrifugal force of the wheels (i.e. acting as flywheels) to be transformed into a torque reaction effecting the entire body/chassis (and other pair of wheels) with respect to that pair of wheels and will thereby induce stunt forces resulting in a plurality of different stunt maneuver capabilities. These principles apply when driving one or more gyroscopic action wheels at a time. The only limitation on stunt maneuverability resulting from these forces is the user's ability to control the motors. As mentioned previously, the pairs of gyroscopic action wheels can be opposing pairs (e.g., rear pair or front pair) and cooperating pairs (i.e., front and rear wheels on same side of vehicle).

In each embodiment disclosed herein, the overall weight of the toy with respect to the combined mass of the gyroscopic action wheels increases the performance of the toy vehicle. By minimizing the combined weight of the vehicle and internal components with respect to the weight of the wheels, the scope of dynamic stunt actions is significantly broadened. The body and chassis is preferably as light as physically possible (with respect to the overall mass of the toy) with a centrally located center of gravity (i.e., with respect to the wheelbase) so that the wheels (which act as gyros) can best influence stunt action of the vehicle. The torque reaction of opposing wheels or wheel pairs causes a range stunt inducing forces equal to or greater than the gyro effect created by each of the respective wheels. Thus, when the torque reaction and gyro effect are combined, another range of stunt inducing actions/forces are possible.

In accordance with one embodiment, the combined body/chassis weight without a battery is approximately 600 grams, while the combined mass of the front and rear wheels is approximately 500 grams. Thus, the total mass of the toy with the wheels is approximately 1100 grams. Thus, there is a 6:5 weight ratio between the body/chassis and wheels, and an 11:5 weight ratio between the overall toy mass (with wheels) and the wheels themselves. When wheels of different diameters are used (see FIG. 7), the mass of the front and rear wheels will be different (e.g., rear≈280 grams, and front≈220 grams), yet still must maintain a desired combined weight with respect to the overall toy mass. When a battery pack (≈180 g) is added to the body/chassis, this weight ratio between the body/chassis and wheels changes to 7.8:5, while the weight ratio between the overall toy mass (with wheels) and the wheels themselves becomes 12.8:5. Thus, it can be seen that the combined wheel mass (front and rear wheels) is at least 40% of the overall mass of the toy, and at least 60% of the chassis/body mass (without the wheels). The preferred battery pack is a 9.6 volt nickel cadmium battery centrally disposed within the body/chassis and as close to the ground as possible to help lower the overall center of gravity of the toy, and thereby further increase the stability during operation. Those of skill in the art recognize that other weight ratios that maintain the desired minimum relationships between the wheel mass and the overall toy mass may be implemented without departing from the spirit of the invention.

Figure 3:
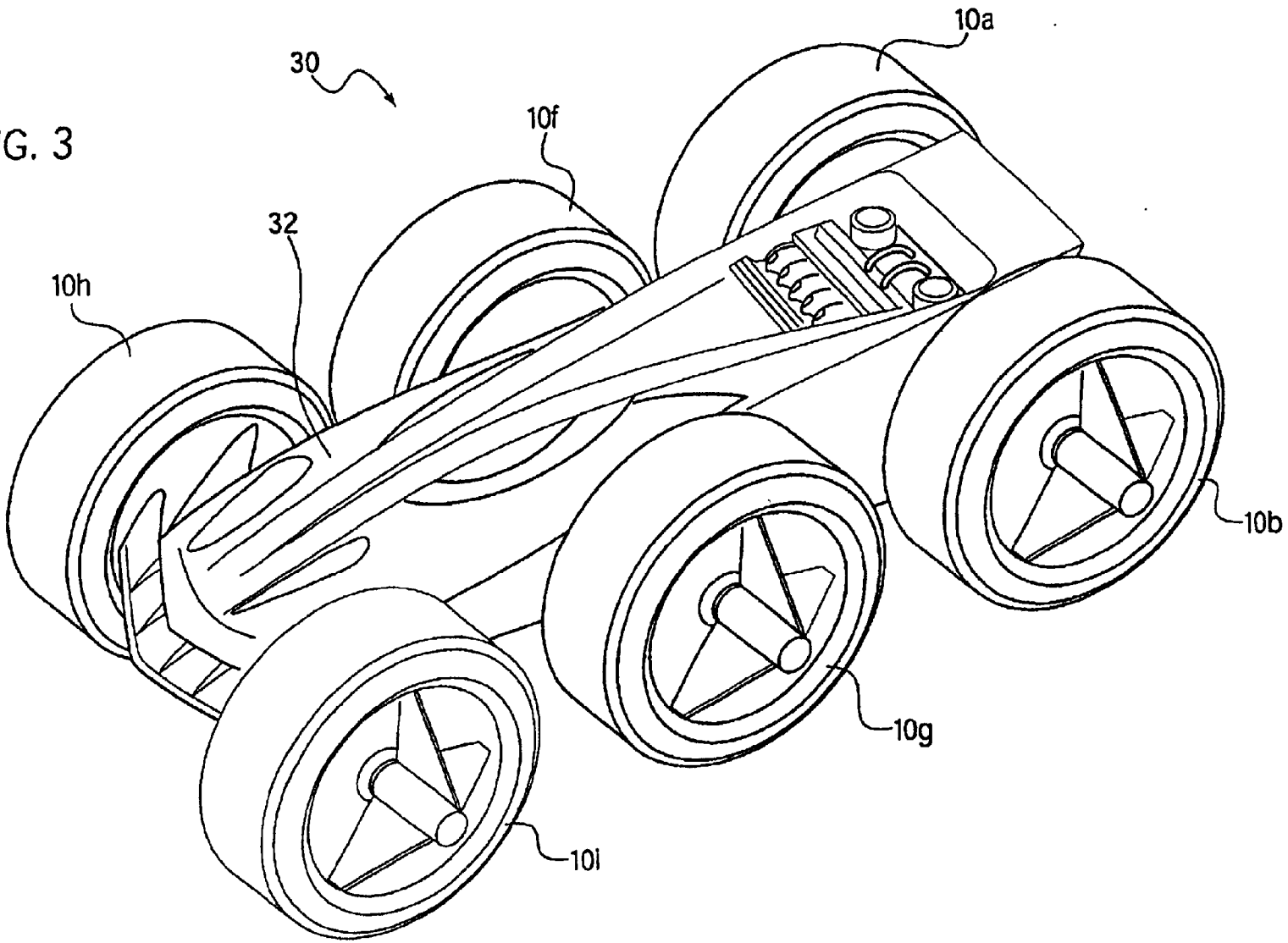
FIG. 3 is a perspective view of a toy having six gyroscopic action wheels according to a third embodiment of the invention.

FIG. 3 shows a six (6) wheel toy 30 similar to that described in FIG. 2, having a main body 32 and another pair of driven gyroscopic action wheels. In this embodiment, all six wheels 10*a*, 10*b*, 10*f*, 10*g*, 10*h*, and 10*i* are driven. Each of the three opposing pairs of wheels 10*a*, 10*b*, 10*f*, 10*g* and 10*h*, 10*i* also maintain an inside track distance relationship that works in conjunction with the gyroscopic action of the six driven wheels at the largest possible diameter to increase the stunt action of the toy vehicle.

Figure 4:
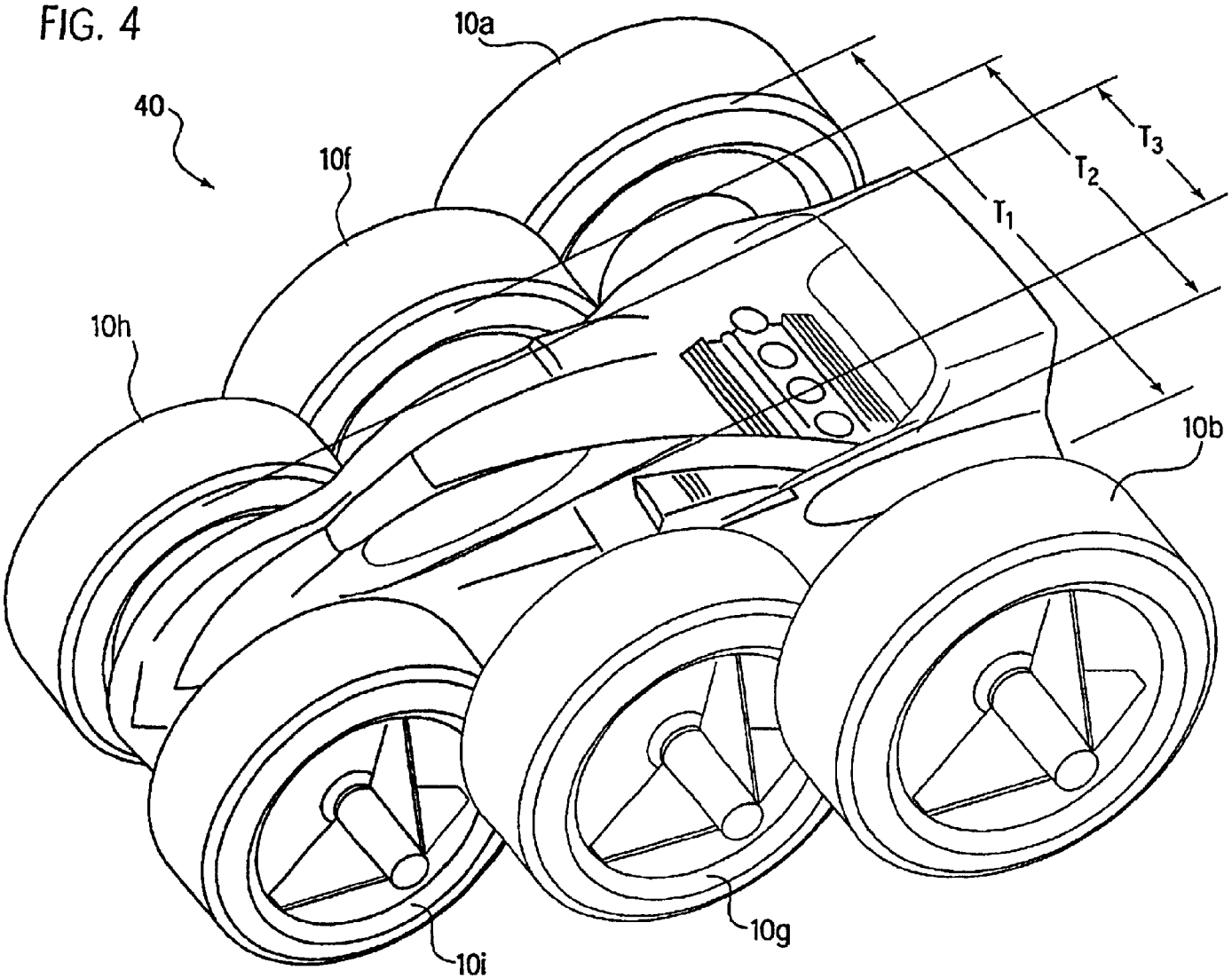
FIG. 4 is a perspective view of a toy having six gyroscopic action wheels according to a fourth embodiment of the invention.

FIG. 4 shows another embodiment of a six (6) wheel radio controlled toy vehicle 40. In this embodiment, the inside track distances $T_1$, $T_2$ and $T_3$ between the respective pairs of opposing wheels 10*a*, 10*b*, 10*f*, 10*g* and 10*h*, 10*i* are different. This difference in inside track distances enables an overlapping wheel arrangement of the vehicle 40. The overlapping of the wheels allows for larger wheel outer diameters for a given overall vehicle length (i.e., front edge of front wheel to the rear edge of the rear wheel), whereas the end to end placement of the wheels limits the outer diameters of the wheels for a given vehicle length. The increased wheel diameters of the wheels increases the gyroscopic action of the wheels which, in combination with the overlapping wheel arrangement, also results in a broadened scope of the stunt actions, due to dynamic variations in wheel contact with the running surface.

Figure 5:
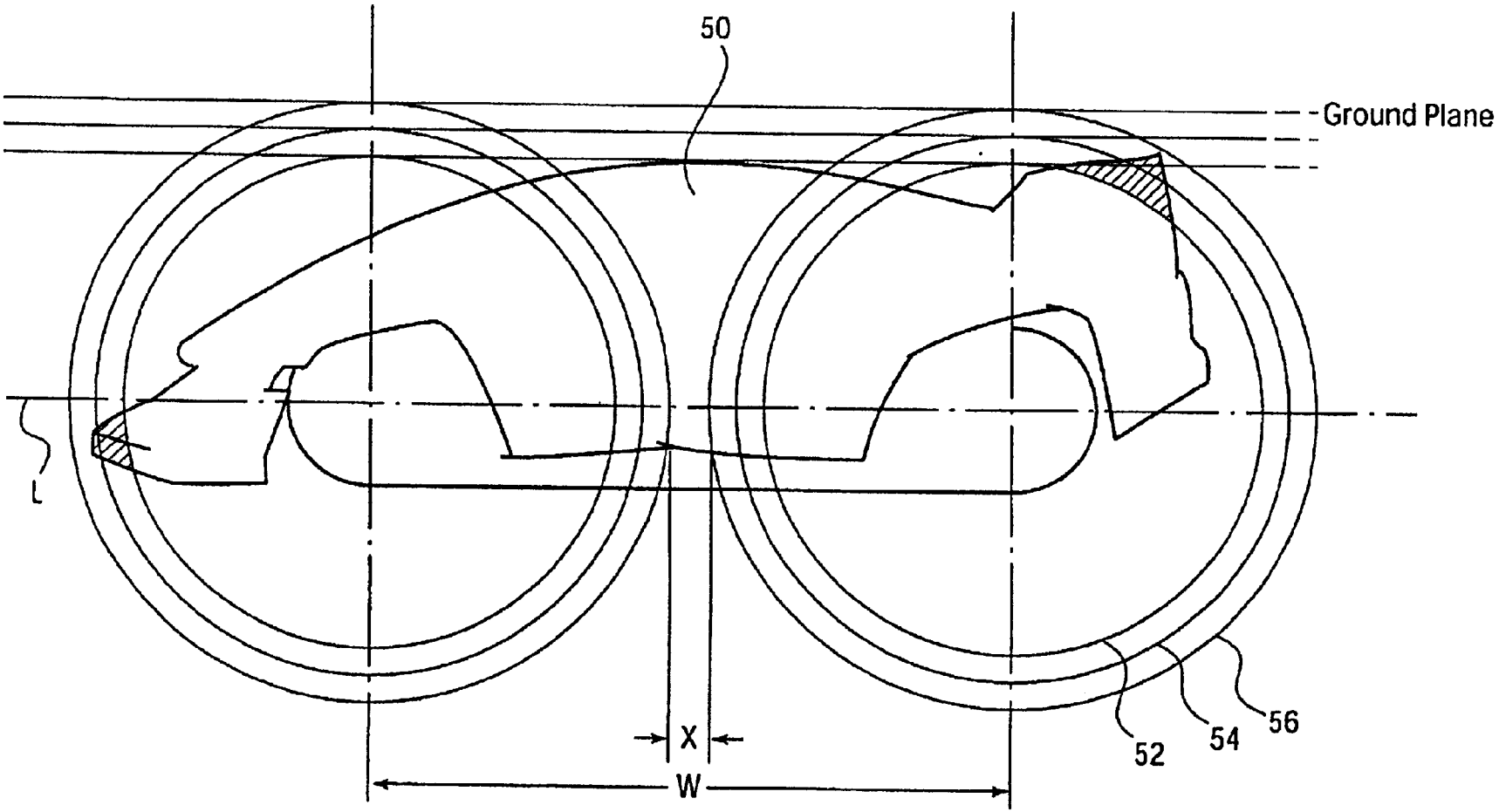
FIG. 5 is a schematic representation of various wheel diameters of the gyroscopic action wheels of the present invention.

FIG. 5 shows a toy vehicle main body 50 and the arrangement of the main body on gyroscopic action wheels of varying diameter. Three different diameter wheels 52, 54 and 56 are shown with their size and disposition with respect to body 12. The diameter of these wheels can vary depending on the desired application and/or vehicle aesthetics. Front and rear wheels can be of different diameters as well. Those of ordinary skill will also recognize that the tread on the wheel may also be varied with the diameter to achieve various levels of traction depending on the operating environment. For example, a knobby tread may be desirable on a smaller diameter wheel to increase traction in dirt applications, while a slick tread would be desirable for a larger diameter wheel on road type conditions to help achieve maximum speed output per revolution of the wheel.

Those of ordinary skill will also recognize that the disposition of main body 50 with respect to the longitudinal axis L can also be varied depending on the size of the wheels and in order to lower the vehicle toward the longitudinal axis and thereby lower its overall center of gravity.

Figure 6B:
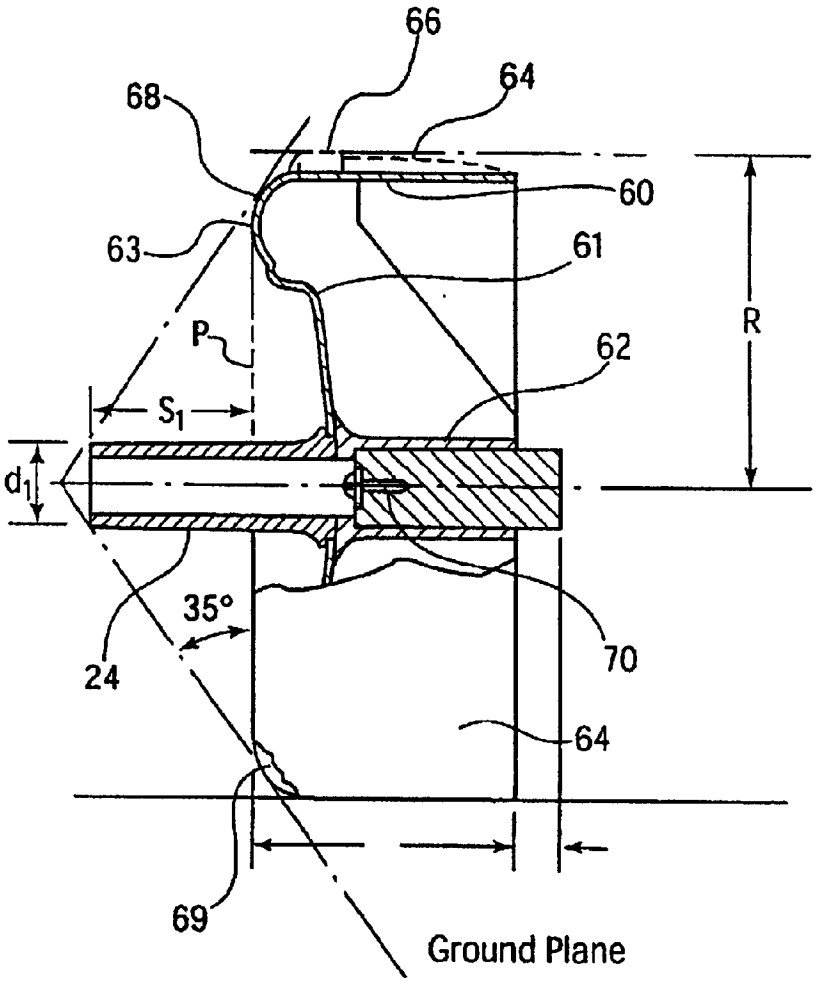
FIG. 6*b* is a partial cross-sectional view of the gyroscopic action wheel taken along line VI—VI of FIG. 6*a;*
Figure 6A:
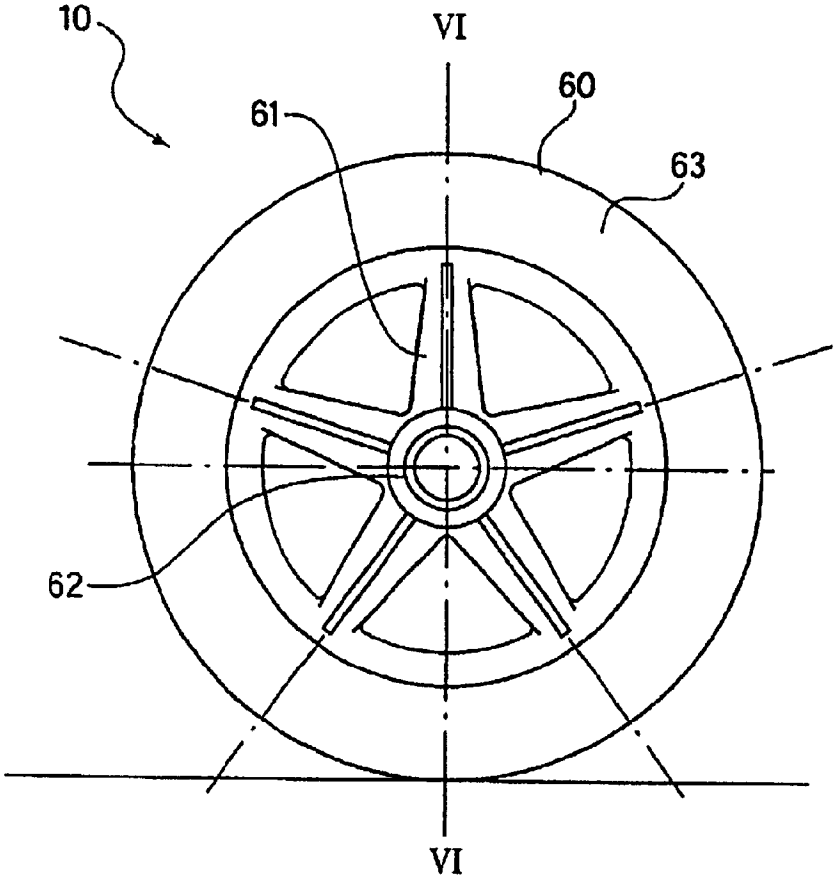
FIG. 6*a* is front view of a gyroscopic action wheel according to an embodiment of the present invention.

FIG. 6*a* shows a front view of an embodiment of the gyroscopic action wheel 10 according to the invention. FIG. 6*b* shows a partial sectional view of wheel 10 taken along line VI—VI of FIG. 6*a*. Wheel 10 includes an outer circumferential surface 60 with spokes 61 connecting the rim 60 with a central hub 62. A vinyl or rubber tire 64 can be added to rim 60 to cover the same and provide increased traction on dry smooth terrain. A harder durometer tire with little or no tread allows quicker rotational acceleration of the wheel due to less frictional contact with the ground, thereby causing the gyroscopic effect to be achieved much faster. The vinyl or rubber tire 64 can also include a rib 66 that provides further traction advantages during stunts and/or changes of terrain. The rim 60 can also include area 68 that is curved over the edge and becomes a sidewall 63 of the wheel 60. The curved portion 68 of sidewall 63 is integral for stunt moves involving stunt tubes 24 where the toy vehicle rides on these sidewalls and stunt tubes for extended periods of time. The radius of curvature of portion 68 can be, for example, ⅛"–2". In addition, a hard plastic rub ring 69 can be disposed on or integrated into the curved portion 68 of the outer circumference of the wheel. The rub ring 69 is in contact with the running surface in place of the tire when the vehicle is operating at certain angles. The rub ring allows the wheels to "spool" or spin up to centrifugal speeds even when that wheel is still in contact with the running surface.

Figure 9:
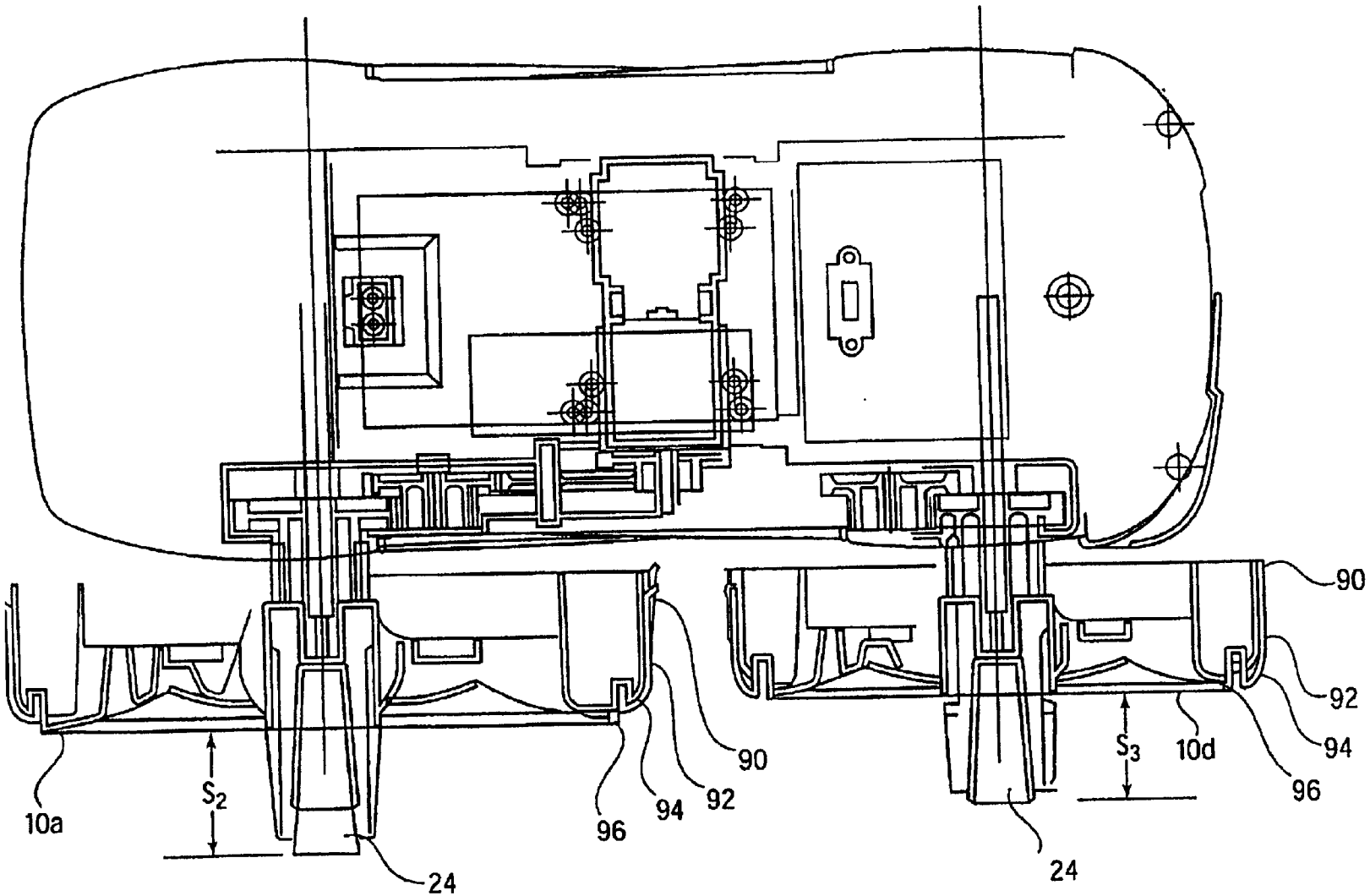
FIG. 9 is a top partial sectional view of the toy vehicle having different size front and rear wheels and showing the variations of the wheels surfaces.

Since the angle of contact of any give wheel at any given time changes, the wheels are designed to have various materials having different coefficients of friction disposed in different positions on the outer circumference of the wheel. By way of example, the rub ring 69 has a lower coefficient of friction than a softer rubber material (e.g., rubber or vinyl 64). Thus, when the toy is operated at the angle along curved portion 68 that includes rub ring 69, the frictional contact with the running surface will decrease and the respective wheel can spin or spool energy (depending on the frictional contact of the other wheels and the respective coefficients of friction associated therewith). FIG. 9 shows a partial cross section of the wheels 10*a* and 10*c*. By way of example, it can be seen, that wheels have several different points of contact 90, 92, 94, 96 with the running surface depending on its angle of operation. When these points of contact have differing coefficients of frictions, the range of resulting forces from the control of the gyroscopic action wheels (as described above) increases at an exponential rate. Points of contact 90, 92, 94 and 96 have been shown here for exemplary purposes. Those of skill in the art will recognize that there will be an almost infinite number of points of contact based on the operation of the toy and its stunt action motion caused by the interaction of the centrifugal forces, corresponding torque reactions, and the angular operation of the toy at any given time.

As can be seen from FIGS. 5 and 7, the diameters of the gyroscopic action wheels are preferably such that the toy vehicle 1 can also run upside down. When the vehicle is flipped over and runs upside down, the entire range of stunt forces and action changes because the center of gravity of the toy (that is preferably disposed as low as possible for upright running) is now higher than before. Therefore, the operation of the toy at all varying angles and in all three dimensions is changed with respect to the upright running operation. This provides an even wider range of utility and action for the use. In addition, the varying wheel diameters of the front and rear wheels also contribute to the different operation and force translations resulting from the user's flywheel management (i.e., control of the gyroscopic action wheels) when running the toy upside down.

In accordance with one embodiment, and to enable increase the gyroscopic action of the wheels, the wheel 10 has an overall mass where at least two-thirds of the overall wheel mass is located within at least 20 percent of the outer end of the wheel radius R adjoining the outer circumference of each wheel. Those of ordinary skill recognize that the gyroscopic action of the wheels is dependent on the mass distribution of the wheels in combination with the rotational speed of the same. According to one embodiment, the preferred rotational speed of the wheels is in a range of 800 to 1200 revolutions per minute (r.p.m.) under no load (i.e., not in contact with the ground).

As shown, stunt tube 24 has a length $S_1$ from the front plane P of wheel 10. As the length $S_1$ of stunt tube 24 is increased, the angle at which the vehicle may ride up on its side is decreased. The length $S_1$ must be properly selected for each toy so as to readily allow the vehicle to achieve this angled running stunt (sidewall and stunt tube contacting ground on one side) for an extended period of time. Those of skill in the art will recognize that the in order to achieve a desired angle running (e.g., 35° with respect to the ground plane) the selection of length $S_1$ also depends on the diameter of the respective wheels on which they are mounted. FIG. 9 shows an embodiment where the front wheel 10*d* of smaller diameter than rear wheel 10*a* has a smaller (S3) stunt tube 24 than the rear (S2) stunt tube 24. The size of these stunt tubes can be for example, in a range of 20–40 mm. The range of the angle/edge running can be from 0° (e.g., no stunt tube—allows the vehicle to drive on the outside face 63 of the wheels on one side) to 45° degrees. In addition, stunt tube 24 has a diameter $d_1$ that can also affect the size of the angle at which the toy can achieve angled running. As shown, stunt tube 24 can be screwed into the hub 62 using a screw 70, or can be a snap on type pressure fit to eliminate the need for a screwdriver. When stunt tubes 24 are secured in place, the vehicle can ride on the ends of said stunt tubes at a 90° angle with respect to the running surface.

Stunt tubes 24 can also be removable and can be consumer replaceable with tubes of varying configuration and effective lengths. This removable configuration allows for a whole new set of gyroscopically induced stunt actions to now occur. Stunt tubes 24 can be added to any one or all of the wheels 10 to increase the stunt action of the toy vehicle and enable angled running on wheel edges and stunt tube ends, barrel roles, etc.

Figure 8A:
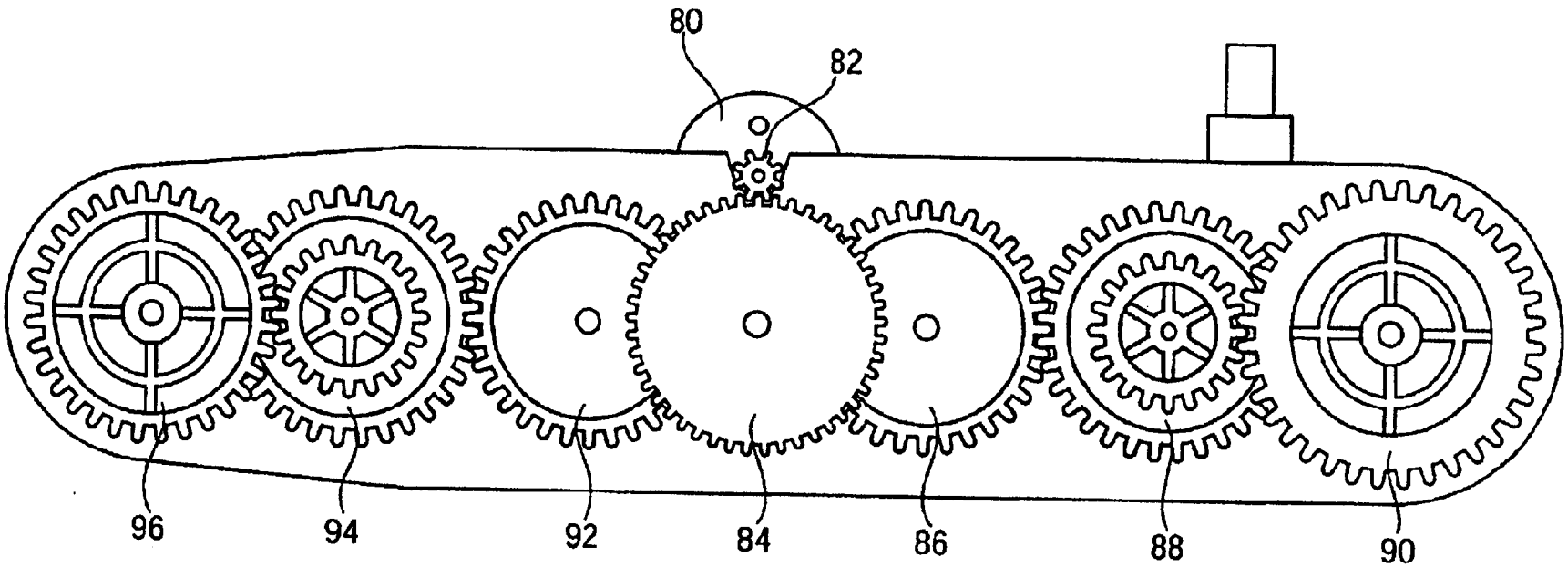
FIG. 8*a* is a plan view of the gearing for the toy having gyroscopic action wheels according to an embodiment of the invention.
Figure 8B:
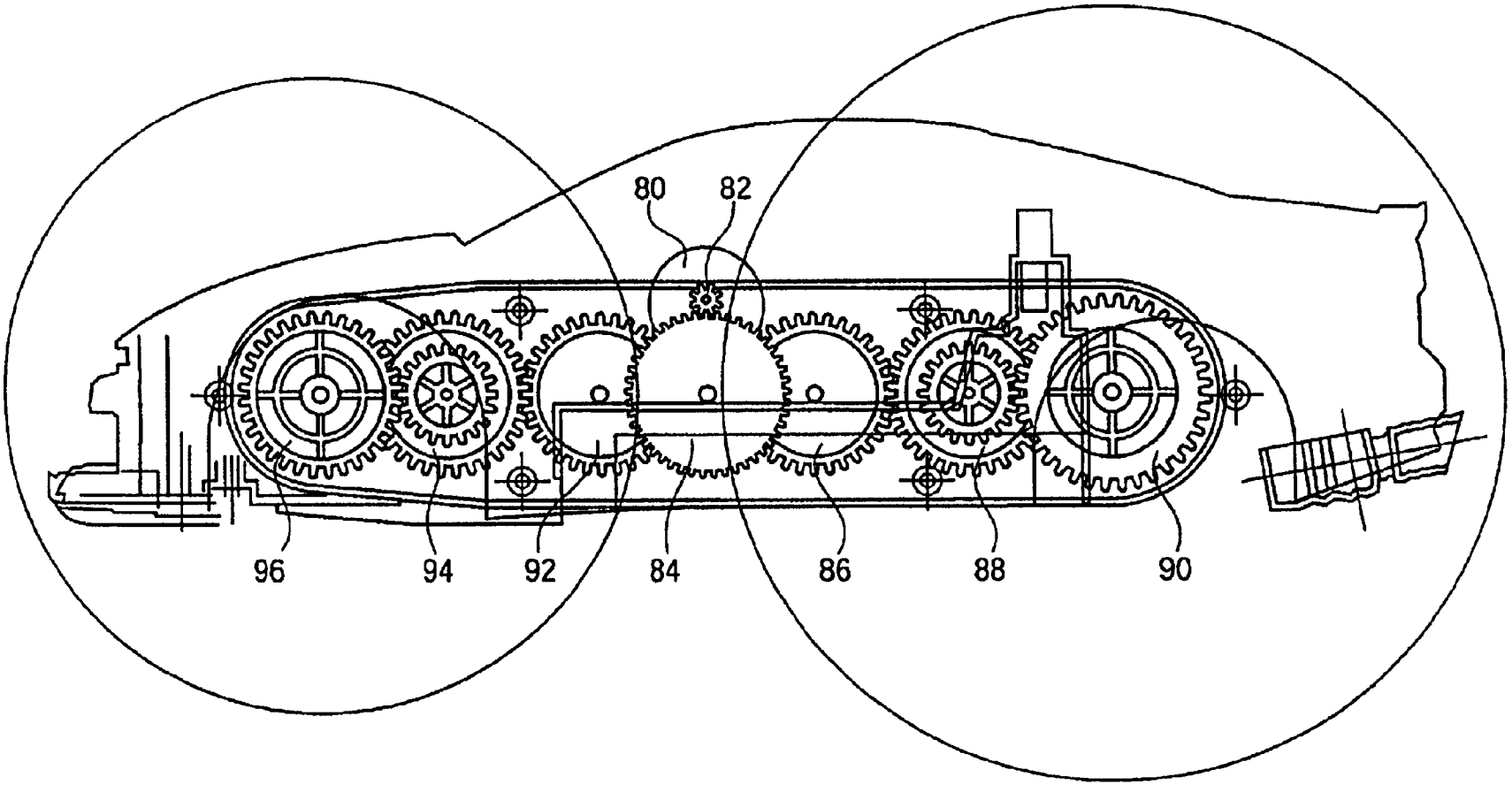
FIG. 8*b* is another plan view of the gearing for the toy have gyroscopic action wheels according to an embodiment of the invention.

FIG. 7 shows another preferred embodiment, where the front wheels have a diameter $D_2$ that is smaller than the rear wheel diameter $D_3$. By changing the diameter of the front wheels with respect to the rear wheels, additional differential and spur gearing is needed in order compensate for the different rotational speeds now required to simultaneously drive the respective side pairs of wheels at similar inch/second velocities at the outer contact surface. FIGS. 8*a* and 8*b* show one embodiment of the differential and spur gearing implemented to compensate for the varying wheel diameters. The motor 80 includes a small spur gear 82 that drives a main gear 84. Main gear 84 drives the rear wheel gear via intermediate gears 86 and 88, and drives the front wheel gear 96 via intermediate gears 92 and 94. As described previously, when the diameter of the front wheel is smaller than that of the rear wheels, the number of teeth and angular disposition of the same on intermediate gears 92 and 94 and front gear 96 is different from that of intermediate gears 86 and 88, and rear gear 90 and as such, must be chosen to compensate for this diameter difference and enable the front wheel and rear wheel to rotate at the same speed. Thus, the gearing ratio for the front gears (92, 94 and 96) is adapted to compensate for the different diameter of the front wheel and enable the front wheel to rotate equally as fast as the rear wheel of a larger diameter. For example, front gears 92, 94 and 96 have a gearing ratio that enables the front wheel to rotate at 1000 rpm under no load (i.e., not in contact with a running surface), while rear gears 86, 88 and 90 rotate the corresponding rear wheel at 900 rpm under no load. When the load is added (i.e., the toy vehicle is placed on the running surface, these rpm ratings may decrease slightly and proportionally with each other. The change in rpm speed is also dependent on the wheel's coefficient of friction with the running surface and the respective part of the wheel that is in contact with the running surface at the respective angle of contact.

While there have shown and described and pointed out fundamental novel features of the invention as applied to preferred embodiments thereof, it will be understood that various omissions, substitutions, changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention.

What is claimed is:

1. A toy vehicle having an overall vehicle mass, the toy vehicle comprising:

a body having opposing sides, a front and a rear;

a rear pair of gyroscopic action wheels aligned with each other on a rotation axle and being operatively connected to the rear of said body;

at least one front gyroscopic action wheel having a rotation axle operatively connected to the front of said body; and means for selectively driving said gyroscopic action wheels at speeds to create a gyro effect at each of said wheels, said gyro effect generating centrifugal forces at each wheel, wherein the centrifugal forces are transformed in torque reactions on the entire toy when at least one of said gyroscopic actions wheels is instantaneously reversed through said driving means, and wherein said rear pair of gyroscopic action wheels and said at least one front gyroscopic action wheel have a combined wheel mass and wherein the combined wheel mass is at least 40% of the overall vehicle mass.

2. The toy vehicle according to claim 1, wherein said driving means comprises:

a first motor and gearing for driving said rear pair of wheels;

a second motor and gearing for driving said at least one front wheel;

radio control electronic circuitry and power supply for receiving remote wireless control commands from a user, said first and second motors being independently controlled by the user.

3. The toy vehicle according to claim 1, wherein said at least one front wheel further comprises a pair of front wheels, and wherein said driving means comprises:

a first reversible motor and gearing for driving a first pair of side wheels defined by one of said rear pair of wheels and one of said front pair disposed on one side of said body;

a second reversible motor and gearing for driving a second pair of side wheels defined by the other of said rear pair of wheels and the other of said front pair of wheels disposed on the other side of said body; and radio control electronic circuitry and power supply for receiving remote wireless control commands from a user, said first and second motors being independently controlled by the user.

4. The toy vehicle according to claim 3, further comprising:

an inside track distance defined as the distance between opposing pairs of wheels; and a wheelbase defined by the distance between the rotation axle of each of the two wheels of each respective side pairs, wherein said inside track and said wheelbase are substantially equal.

5. The toy vehicle according to claim 3, wherein said driving means further comprises:

a first set of gears operatively connected to said first motor and transmitting rotational motion of said motor to said first side pair of wheels equally; and a second set of gears operatively connected to said second motor for transmitting rotational motion of said second motor to said second side pair of wheels equally.

6. The toy vehicle according to claim 5, wherein each of said wheels have a diameter, and said diameters are equal to each other.

7. The toy vehicle according to claim 5, wherein each of the wheels have a diameter, said front wheels having a diameter smaller than the diameter of said rear wheels.

8. The toy vehicle according to claim 1, wherein each of said wheels have an outer circumferential surface having varying coefficients of friction based on the point of contact with a running surface on which the toy is being operated.

9. A radio controlled toy vehicle having an overall vehicle mass, the toy vehicle comprising:

a body having opposing sides, a front and a rear;

a rear pair of gyroscopic action wheels aligned with each other on a rotation axle and being operatively connected to the rear of said body;

a front pair of gyroscopic action wheels aligned with each other on a rotation axle being operatively connected to the front of said body; and a first reversible motor and gearing for driving a first pair of side wheels defined by one of said rear pair of wheels and one of said front pair disposed on one side of said body;

a second reversible motor and gearing for driving a second pair of side wheels defined by the other of said rear pair of wheels and the other of said front pair of wheels disposed on the other side of said body; and radio control electronic circuitry and power supply for receiving remote wireless control commands from a user, said first and second motors being independently controlled by a user;

wherein said first and second motors drive said gyroscopic action wheels at speeds to create a gyro effect at each of said wheels, said gyro effect generating centrifugal forces at each wheel, wherein the centrifugal forces are transformed in torque reactions on the entire toy when at least one of said gyroscopic actions wheels is instantaneously reversed through said driving means, and wherein said rear pair and said front pair of gyroscopic action wheels have a combined wheel mass and wherein the combined wheel mass is at least 40% of the overall vehicle mass.

10. The toy vehicle according to claim 9, wherein driving means further comprises:

a first set of gears operatively connected to said first motor and transmitting rotational motion of said motor to said first side pair of wheels equally; and a second set of gears operatively connected to said second motor for transmitting rotational motion of said second motor to said second side pair of wheels equally.

11. The toy vehicle according to claim 10, wherein each of said wheels have a diameter, and said diameters are equal to each other.

12. The toy vehicle according to claim 10, wherein each of the wheels have a diameter, said front wheels having a diameter smaller than the diameter of said rear wheels, said first and second gearing being adjusted to compensate for the smaller diameter of said front wheels and enable substantially equal inch/second velocities of said front and rear wheels.

13. The toy vehicle according to claim 10, wherein each of said wheels have an outer circumferential surface having varying coefficients of friction based on the point of contact with a running surface on which the toy is being operated.

* * * * *